US007036705B1

(12) United States Patent
Fredrickson et al.

(10) Patent No.: US 7,036,705 B1
(45) Date of Patent: May 2, 2006

(54) AUTOMATED MULTIPLE POINT FASTENER DRIVING SYSTEM

(76) Inventors: Clyde R. Fredrickson, P.O. Box 250, Britton, SD (US) 57430; Mark Wismer, P.O. Box 250, Britton, SD (US) 57430; Drew Fredrickson, P.O. Box 250, Britton, SD (US) 57430

( * ) Notice: Subject to any disclaimer, the term of this patent is extended or adjusted under 35 U.S.C. 154(b) by 0 days.

(21) Appl. No.: 10/368,984

(22) Filed: Feb. 18, 2003

(51) Int. Cl.
*B27F 7/00* (2006.01)

(52) U.S. Cl. ..... 227/39; 227/40; 227/43; 227/102

(58) Field of Classification Search ..... 227/39, 227/40, 43, 102, 44
See application file for complete search history.

(56) References Cited

U.S. PATENT DOCUMENTS

| | | | | |
|---|---|---|---|---|
| 3,765,587 | A * | 10/1973 | Davis | 227/100 |
| 3,837,556 | A | 9/1974 | Doyle et al. | |
| 4,005,520 | A * | 2/1977 | Sanford | 29/432 |
| 4,039,112 | A * | 8/1977 | Schultz | 227/40 |
| 4,163,321 | A | 8/1979 | Cunningham | |
| 4,334,346 | A * | 6/1982 | Jensen | 29/429 |
| 4,516,675 | A | 5/1985 | Koskovich | |
| 5,653,039 | A | 8/1997 | Frohlich et al. | |
| 6,058,665 | A | 5/2000 | Halvorson, Jr. et al. | |
| D435,205 | S | 12/2000 | Etter et al. | |
| 6,666,367 | B1 * | 12/2003 | Ohnesorge et al. | 227/100 |
| 6,763,567 | B1 * | 7/2004 | Smith et al. | 29/430 |
| 2002/0127093 | A1 | 9/2002 | Aylsworth | |

OTHER PUBLICATIONS

Merrick Machine Company Alda, Nebraska Jan. 20, 2003.

* cited by examiner

*Primary Examiner*—Scott A. Smith
*Assistant Examiner*—Brian Nash
(74) *Attorney, Agent, or Firm*—Woods Fuller Shultz & Smith PC; Jeffrey A. Proehl

(57) ABSTRACT

An automated multiple point fastener driving system is disclosed for driving fasteners into a plurality of structural elements for connecting the elements together while the elements are substantially continuously moving along a path The automated multiple point fastener driving system includes a frame with the path extending through the frame for movement of structural elements, a moving assembly for moving a plurality of structural elements along the path in a substantially continuous manner, an entry clamping assembly for clamping together the structural elements as the elements move substantially continuously along the path, an alignment assembly for aligning at least one edge of the plurality of structural elements as the elements move substantially continuously along the path, and fastener driving assembly for driving fasteners into the plurality of structural elements as the elements move substantially continuously along the path.

21 Claims, 6 Drawing Sheets

AUTOMATED MULTIPLE POINT FASTENER DRIVING SYSTEM

BACKGROUND OF THE INVENTION

1. Field of the Invention

The present invention relates to automated fastener driving systems and more particularly pertains to a new automated multiple point fastener driving system for driving fasteners into a plurality of structural elements for connecting the elements together while the elements are substantially continuously moving along a path.

2. Description of the Prior Art

Traditionally, many components of structures, especially so-called "tick built" wood structures for home and businesses, have been assembled on the site at which the structure is to be erected. More and more, production of various components have been moved off-site to manufacturing facilities where the components for many structures are assembled on the same production line in an often more hospitable environment. One of the biggest challenges to producing such components on a production line is the significant variability in the sizes and shapes that may occur in the same type of structural component. One example of this challenge is the large range of sizes and shapes for that roof support trusses that may be used on the same structure, especially, for example, in custom-built homes. Thus, the significant variability of home design has made it more difficult to apply production line practices to the manufacture of components that would otherwise be stick built on site.

While large scale production of roof support trusses is becoming more common, large scale line production of other components, such as those for assembling the walls of the structures, including headers and beams for positioning over openings in the walls, has remained relatively limited due at least in part to the significant variability of the sizes and shapes of these wall components. The most progress appears to be in beams that are constructed out of lumber (or composites) that are glued together to form the larger beam, but these components can be significantly more expensive and often require pre-ordering ahead of the time of use to be sure that the component is available for use at the appropriate time.

Some initial steps have been made to make the construction of these wall components in a production line environment. For example, the Triad CN-4 apparatus available from the Merrick Machine Company of Alda, Nebr. is a "sub-component nailer" that is designed to facilitate the nailing of boards together into structural components. In operating this device, the structural elements that are to form the component must be manually positioned with respect to each other, and then clamped in place on a horizontal support, so that they remain stationary during the nailing operation. The structural elements thus do not move continuously with respect to the apparatus, especially when the elements are clamping in a single position for fastening. A movable carriage is moved across the support and along the length of the stationary structural elements. This apparatus is most effective when a number of identical or virtually identical components are to be produced on the apparatus, as variation in the components requires resetting of various adjustments on the apparatus, including the spacing between the fasteners. However, significant variations in the sizes of the building elements require significant resetting of the adjustments for each variation.

In these respects, the automated multiple point fastener driving system according to the present invention is believed to overcome these disadvantages and permits the production of components out of structural elements in a manner that is faster and more efficient than stick built components built on site, and also handles variability in the size and shape of the components more efficiently than the known fastening apparatus.

SUMMARY OF THE INVENTION

In view of the foregoing disadvantages inherent in the known types of fastener driving systems now present in the prior art, the present invention provides a new automated multiple point fastener driving system wherein the same can be utilized for driving fasteners into a plurality of structural elements for connecting the elements together while the elements are substantially continuously moving along a path.

To attain this, in one aspect of the present invention, an apparatus is provided that generally comprises a frame with a path extending through the frame for movement of structural elements, moving means for moving a plurality of structural elements along the path in a substantially continuous manner, an entry clamping assembly for clamping together the structural elements as the elements move substantially continuously along the path, an alignment assembly for aligning at least one edge of the plurality of structural elements as the elements move substantially continuously along the path, and fastener driving means for driving fasteners into the plurality of structural elements as the elements move substantially continuously along the path.

In another aspect of the invention, a method is disclosed for fastening structural elements together in a continuous fashion to form a structural component.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability of the system of the invention to move the structural elements substantially continuously along a path on the apparatus and drive the fasteners into the elements at the appropriate locations while the elements are moving. Another advantage is the ability of the system of the invention to adjust to the variations in the size or sizes of the structural elements, and drive the fasteners at the appropriate places for the size of the component.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
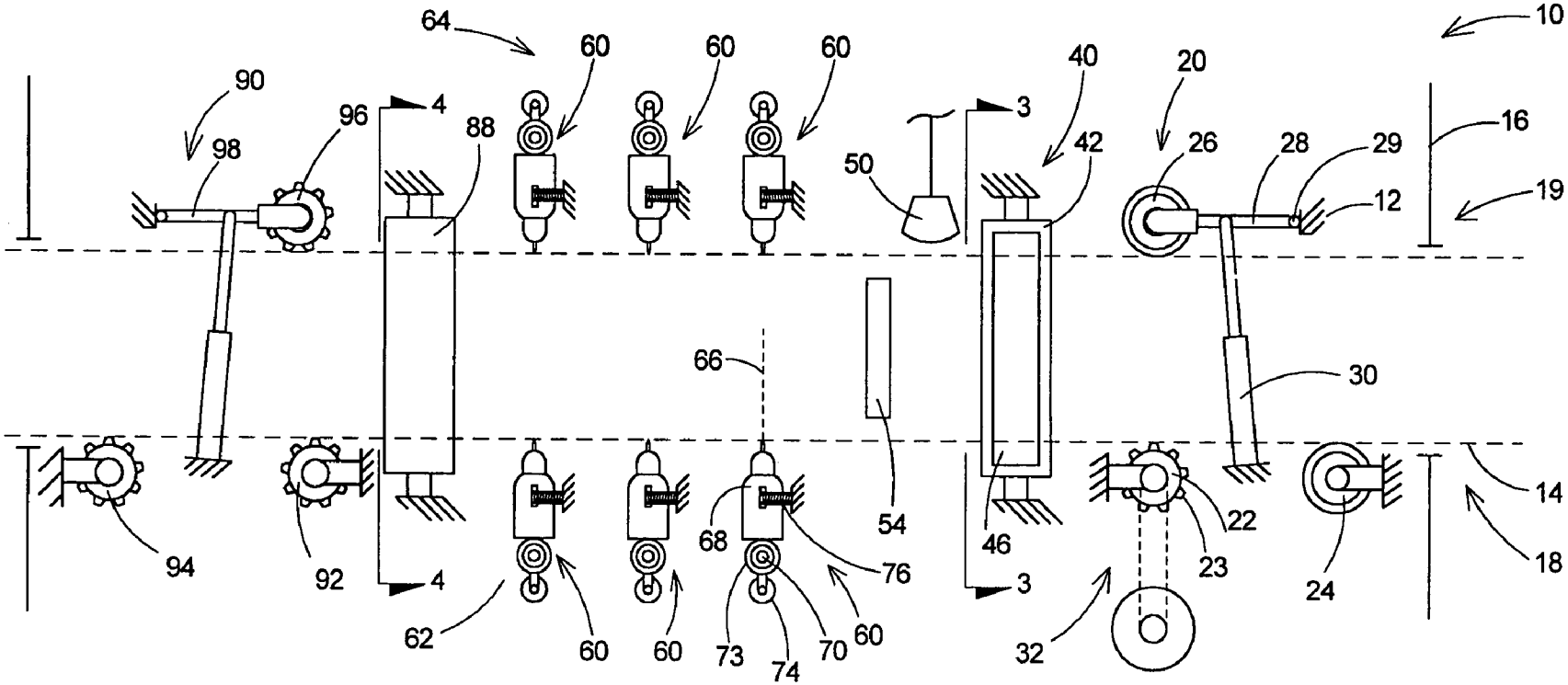
FIG. 1 is a schematic top view of a new automated multiple point fastener driving system according to the present invention with most of the supporting frame structure removed to reveal the detail of the elements of the system. It should be understood that each of the groups of skewed lines shown in the Figures represents an attachment to the frame of the present invention and each group is relatively stationary relative to the other groups.

With reference now to the drawings, and in particular to FIGS. 1 through 6 thereof, a new automated multiple point fastener driving system embodying the principles and concepts of the present invention and generally designated by the reference numeral 10 will be described.

As best illustrated in FIGS. 1 through 6, the automated multiple point fastener driving system 10 generally comprises an entry clamping assembly 20 for clamping together the structural elements moving along the path, an alignment assembly 40 for pressing against the structural elements to substantially align at least one set of edges of the structural elements, fastener driver assemblies 60 for driving fasteners into the structural elements to connect them together, and an exit clamping assembly 90 for moving the connected structural elements out of the system.

As used herein, structural element is intended to include elements formed of any and all materials that may suitably used to form a structural member or component. In one illustrative example of a highly useful application of this invention, boards, such as those fashioned out of wood or a wood composite material, are fastened together to form a structural member or component. Such structural components may include, but are not limited to, headers, corners, jack stud assemblies, channels, beams, columns, and virtually any combination of structural elements employed in walls and even ceilings of buildings. Applicable building codes may dictate, or at least set a minimum standard for, the spacing and orientation of the fasteners used to connect the structural elements together to form these various structural components.

Figure 2:
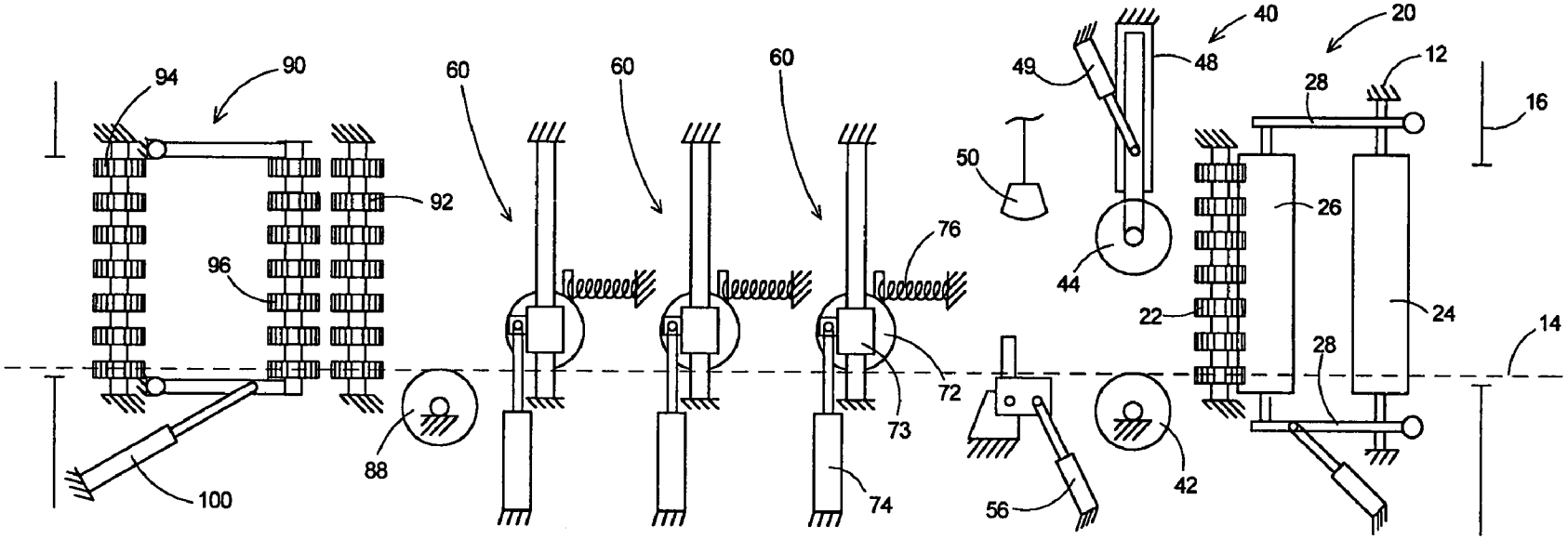
FIG. 2 is a schematic side view of the present invention with most of the supporting frame structure removed to reveal the detail of the elements of the system.

The system 10 of the invention includes a frame 12 to which most of the other components and elements of the system are fixedly or pivotally mounted (see FIGS. 1 and 2). In the drawings, a major portion of the frame has been omitted as one skilled in the art may devise a multitude of ways to support the various elements of the frame, and therefore the attachments of the elements to the frame 12 have been represented by skewed lines, as is conventional in drawings. The system 10 may also include an enclosure or housing 16 that may be comprised of panels or walls positioned about the frame 12 and the elements of the invention for enclosing significant portions of the system for aesthetic and safety purposes. The system 10 includes a path 14 for moving the building elements along before, during, and after the fastening operation. The path 14 may extend through the frame 12 and the housing 16 with the path preferably, although not critically, being substantially horizontally oriented and substantially linear. The path 14 may define a first side 18 of the path and a second side 19 of the path, and various components of the invention may be described herein as being positioned on the first side or the second side of the path.

Figure 3:
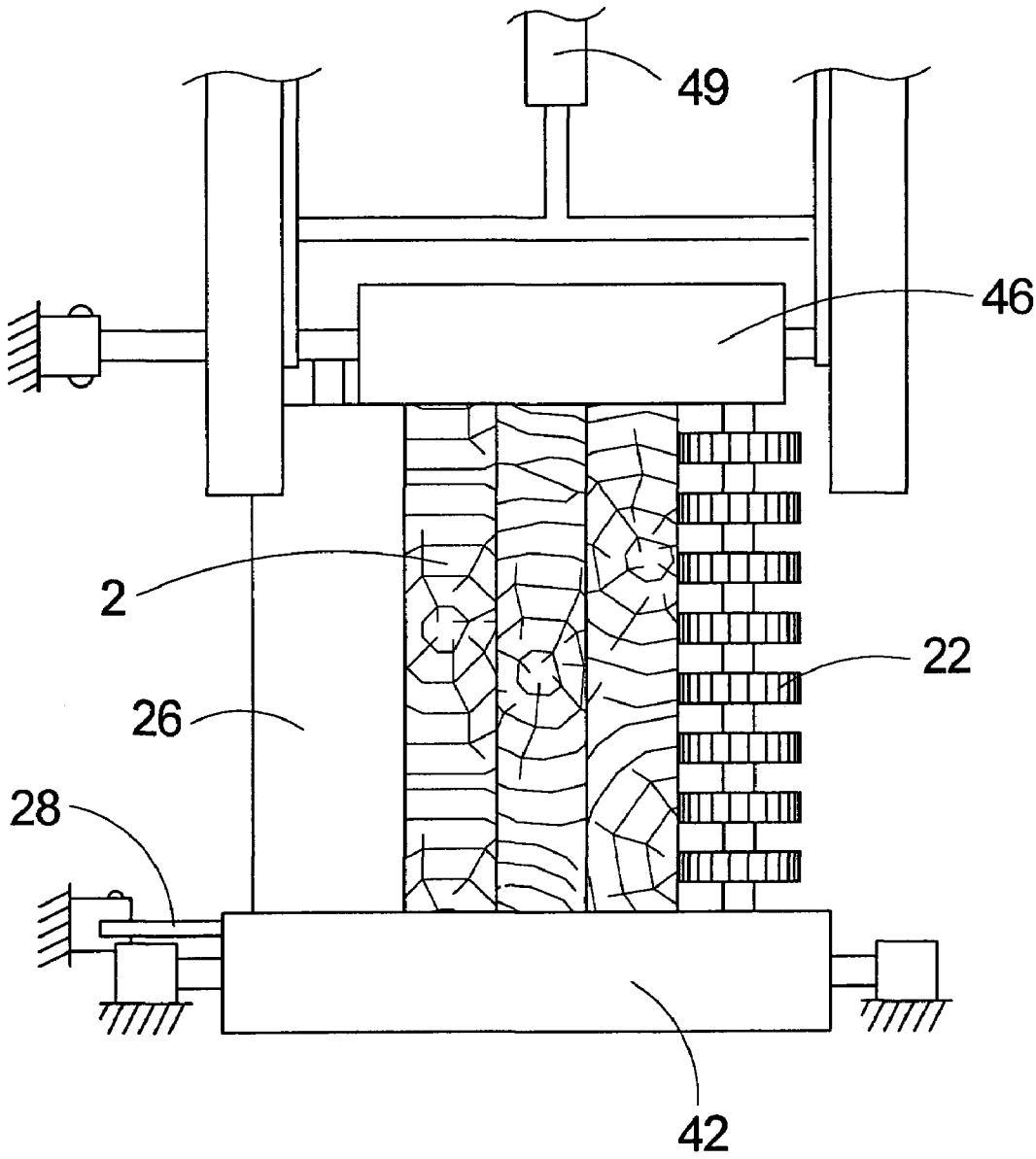
FIG. 3 is a schematic sectional view of the present invention taken along line 3—3 of FIG. 1 and particularly illustrating elements of the entry clamping assembly in relation to a plurality of building elements moving along the path.

An entry clamping assembly 20 may be provided in the system 10 for clamping together a plurality of the structural elements moving along the path prior to, and during, the fastening of the elements together (see FIGS. 1 through 3). The clamping force is typically applied to the structural elements on their faces so that the adjacent faces of the elements are pressed together. In one embodiment of the invention, the entry clamping assembly 20 includes a primary entry clamping roller 22 that may be located on and adjacent to the first side 19 of the path. The primary entry clamping roller 22 may be rotatable about a substantially vertical axis, and the roller 22 may be mounted so as to be substantially stationary with respect to the frame 12. Preferably, the primary entry clamping roller 20 has a plurality of protrusions 23 extending therefrom to permit the roller 20 to securely engage a structural element without any significant slippage therebetween. In the illustrative embodiment of the invention, the primary entry clamping roller 22 is formed of a central rod and a plurality of chain sprockets mounted on the rod in a manner prevent rotation of the sprockets with respect to the rod (see FIGS. 2 and 3). While other roller configurations could be employed, the aforedescribed configuration has been found to be highly suitable for gripping the structural elements by digging the sprocket teeth into the relatively soft wood of common structural elements and thereby resist slippage of the roller with respect to the structural element, especially as the roller 22 may be rotated under power in order to move the structural elements along the initial, or entry, portion of the path 14.

The entry clamping assembly 20 of the system 10 may also include a secondary entry clamping roller 24, which may be located on the first side 18 of the path adjacent to, but generally upstream from, the primary entry clamping roller 22. The secondary entry clamping roller 24 may also be rotatable about a substantially vertical axis, and also may be mounted so as to be substantially stationary with respect to the frame 12. The secondary entry clamping roller 24 may provide a second point of contact for the structural elements moving along the path 14 so that relatively straight movement of the elements along the path is facilitated. In the illustrative embodiment of the invention, the secondary entry clamping roller 24 may be substantially cylindrical with a relatively smooth surface.

The entry clamping assembly 20 may also include a biasing entry clamping roller 26 for selectively clamping one or more structural elements moving along the path 14 against the primary entry clamping roller 22. The biasing entry clamping roller 26 is movable with respect to the frame 12, and is biased or urged toward the primary clamping roller 22. The biasing entry clamping roller 26 may be located on the second side 19 of the path 14, generally across the path from the primary entry clamping roller 22, and is biased toward the first side 18 of the path and the roller 22. The biasing entry clamping roller 26 may also be rotatable about a substantially vertical axis. The biasing entry clamping roller 26 may have a substantially cylindrical, smooth exterior.

The entry clamping assembly 20 may also include structure (and the equivalents thereof) for supporting the biasing entry clamping roller 26, and urging or biasing the roller 26 toward the primary entry clamping roller 22. In one embodiment of the invention, the means for biasing the biasing entry clamping roller 26 includes a first swing arm 28 that is pivotally mounted on the frame 12 and on which the biasing entry clamping roller 26 is mounted. The first swing arm 28 is pivotable between a non-biasing position on the second side of the path 14 and a biasing position extending across at least a portion of the path 14. The structure of the assembly 20 that biases the biasing entry clamping roller 26 may also include an entry biasing actuator 30 for biasing the roller 26 toward the primary entry clamping roller 22. The entry biasing actuator 30 may comprise a hydraulic actuator having a first end operatively coupled (such as, for example, by pinning) to the frame 12 and a second end operatively coupled to the first swing arm 28. In the illustrative example, retraction of the actuator 30 moves the biasing entry clamping roller 26 into the path 14 for contacting structural elements in the path, and extension of the actuator 30 moves the roller 26 away from the primary entry clamping roller 22 for releasing any structural elements on the path. Optionally, actuators of other types may also be used including those powered by fluids, gases, and mechanically.

The system 10 of the invention may also include means for rotating the primary entry clamping roller 22 to move the structural elements along the path 14, and may include a motor assembly 32 operatively coupled to the primary entry clamping roller 22 for rotating the roller 22. Illustratively, the motor may be linked to the roller 22 by a system of sprockets and chains, although other means of transferring the rotation of the motor to the roller 22 (and optionally other rollers) may be used.

In one implementation of the invention, one or more generally horizontally-oriented rollers may be positioned just outside of or just inside of the opening in the housing 16 to support building elements entering the system. Optionally, a continuous belt or chain conveyor or the equivalent may also be used at these initial stages of feed for the building elements, which may be especially useful when a group of building elements inserted together into the system have lengths that are not uniform with respect to each other.

The alignment assembly 40 of the system 10 may be provided for aligning together at least one edge of each of the plurality of structural elements moving along the path 14 (FIGS. 1 through 3). The alignment assembly 40 may include an entry support roller 42 for supporting the structural elements moving along the path, and may be positioned below the path 14 such that the structural elements pass over the entry support roller 42 as the structural elements move along the path. The entry support roller 42 may thus provide horizontal support to the structural elements on the path, and the roller 42 may be rotatable about a substantially horizontal axis to facilitate movement of the elements over the roller 42. The alignment assembly 40 may also include a pinching roller assembly 44 for pinching or pressing the structural elements against the entry support roller 42. The pinching roller assembly 44 may include a pinching roller 46 that is positioned generally above the entry support roller 42, and above the path 14, and that is also movable downwardly toward the roller 42. The pinching roller 46 may be rotatable about a horizontal axis for permitting structural elements being pressed by the pinching roller 46 to pass relatively easily between the entry support roller 42 and the pinching roller 46. The pinching roller assembly 44 may also include a pinching roller support structure 48 for supporting and moving and guiding the movement of the pinching roller 46 toward and away from the entry support roller 42. The pinching roller support structure 48 is mounted on the frame 12, and may form a guide track for the movement of the pinching roller 46. The pinching roller assembly 44 may further include a pinching actuator 49 having a first end operatively coupled to the frame 12 and a second end operatively coupled to the pinching roller 46 or the pinching roller support structure 48. Extension of the pinching actuator 49 may move the pinching roller 46 toward the entry support roller 42 and retraction of the pinching actuator may move the pinching roller away from the entry support roller.

In an optional variation of the alignment assembly 40 (see FIG. 6), the pinching roller assembly 40 includes a pinching roller that is comprised of multiple sections 34, 36, and 38 that are independently movable toward the entry support roller 42. This variation is especially useful when structural elements of non-uniform widths (such as, for example, the U-shaped channel shown in FIG. 6) are to be fastened together, yet need to have at least one side edge of each that is aligned with the side edges of the other elements.

The system 10 may also employ means for triggering the pinching or pressing movement of the alignment assembly 40 (such as, for example, by causing extension of the pinching actuator 49) and the clamping movement of the entry clamping assembly 20 (such as, for example, by causing retraction of the entry biasing actuator 30). In one embodiment of the invention, a sensor assembly is employed as a triggering means for sensing movement of the structural elements along the path to cause actuation of the actuators 30, 49. The sensor assembly may comprise an optical sensor 50 that is positioned adjacent to the path 14, and the sensor 50 may be positioned above the path 14 (although other locations may be suitable as long as the sensor is proximate to the path). Optionally, the sensor 50 may be a physically-operated sensor such as a switch. The sensor 50 is preferably located along the path just past, or downstream of, the alignment assembly 40 and the entry clamping assembly 20, so that upon the sensing of one or more structural elements on the path by the sensor, the structural elements are in position on the path to be clamped by the entry clamping assembly and aligned by the alignment assembly.

For initially stopping movement of the structural elements along the path until the alignment assembly 40 and the entry clamping assembly 20 have engaged the elements, the system 10 may also include stopping means which may also function to align forward ends of the elements as they initially move along the path 14. In one embodiment of the invention, the stopping means includes a stop 54 that is movable between a stop position in which the stop 54 extends into the path 14 to prevent movement of the structural elements along the path, and a pass position in which the stop 54 is moved outside of the path 14 to permit movement of the structural elements by the stop 54 to continue along the path (see FIGS. 1 and 2). The stop 54 may be pivotally mounted on the frame 12 so that it may be pivoted between the stop and pass positions. The stop means may also include a stop actuator 56 (see FIG. 2) that moves the stop 54, such as by pivoting, between the stop position and the pass position.

The system 10 also includes means for driving fasteners into the structural elements as they are moved along the path 14. In one embodiment of the invention, the means includes a plurality of fastener driving means, with at least one fastener driving means positioned on the first side 18 of the path 14 and at least one fastener driving means positioned on the second side 19 of the path 14 for driving fasteners generally toward each other. Each of the fastener driving means may comprise a nail driver assembly 60. A first group 62 of nail driver assemblies 60 may be positioned on the first side 18 of the path for ejecting nails across the path from the first side, and a second group 64 of nail driver assemblies 60 may be positioned on the second side 19 of the path for ejecting nails across the path from the second side (see FIG. 1). Each of the nail driver assemblies 60 may eject nails along a nail axis 66 that extends through the path 14 of the structural elements to be fastened (see FIG. 4).

Figure 4:
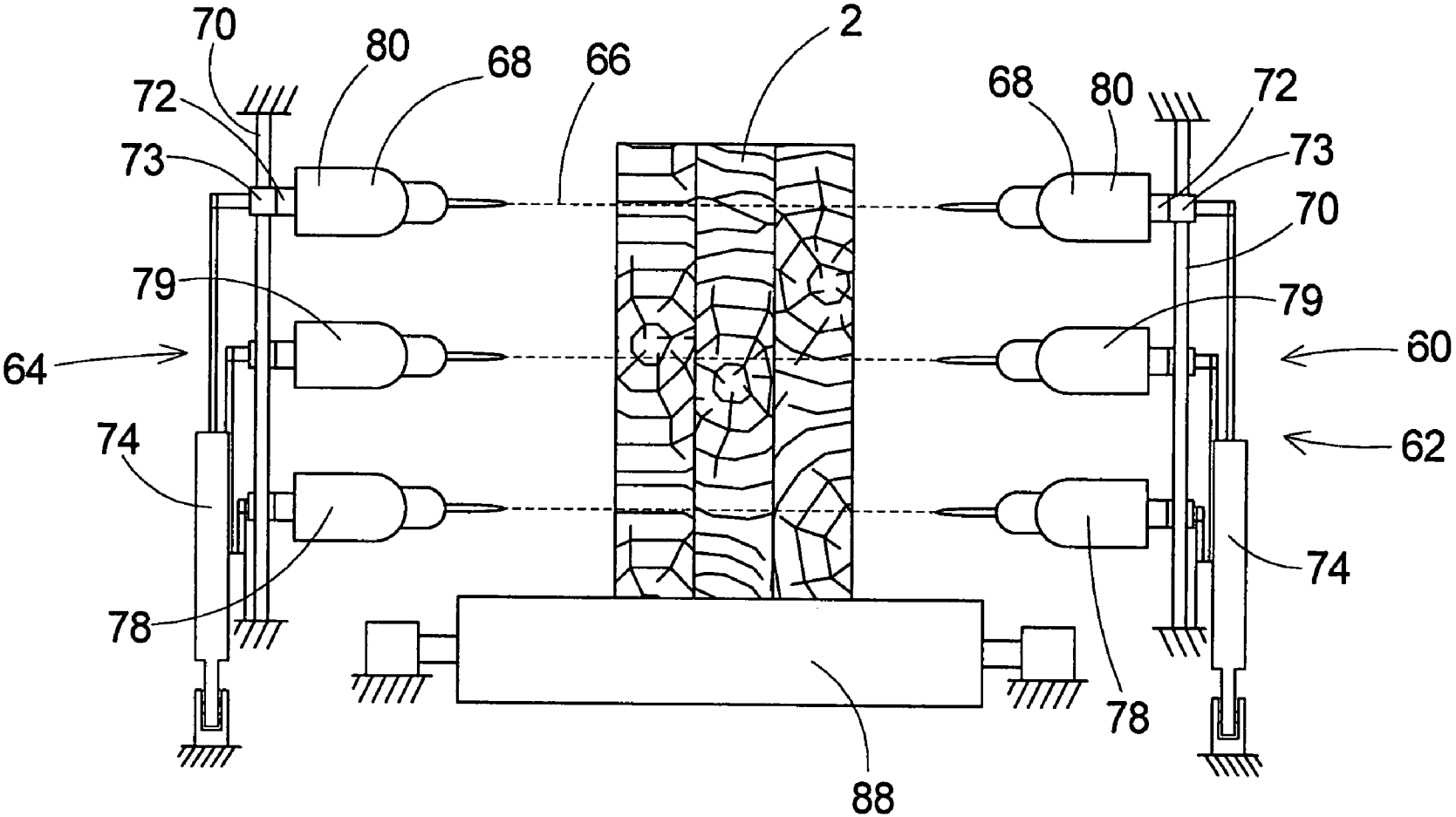
FIG. 4 is a schematic sectional view of the present invention taken along line 4—4 of FIG. 1 and particularly illustrating elements of the nail driver assembly in relation to a plurality of building elements moving along the path, with elements of the entry clamping assembly removed to enhance the clarity of the view.
Figure 5:
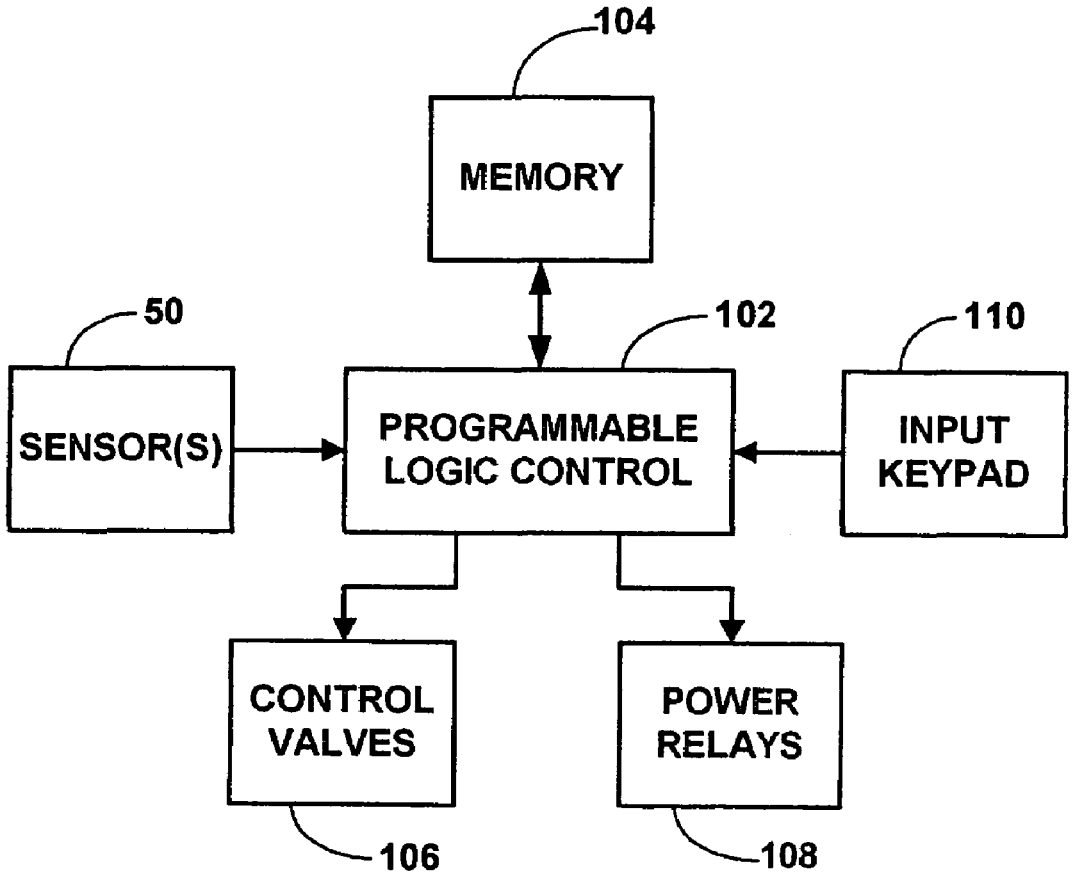
FIG. 5 is a schematic diagrammatic view of controlling elements of the present invention.
Figure 6:
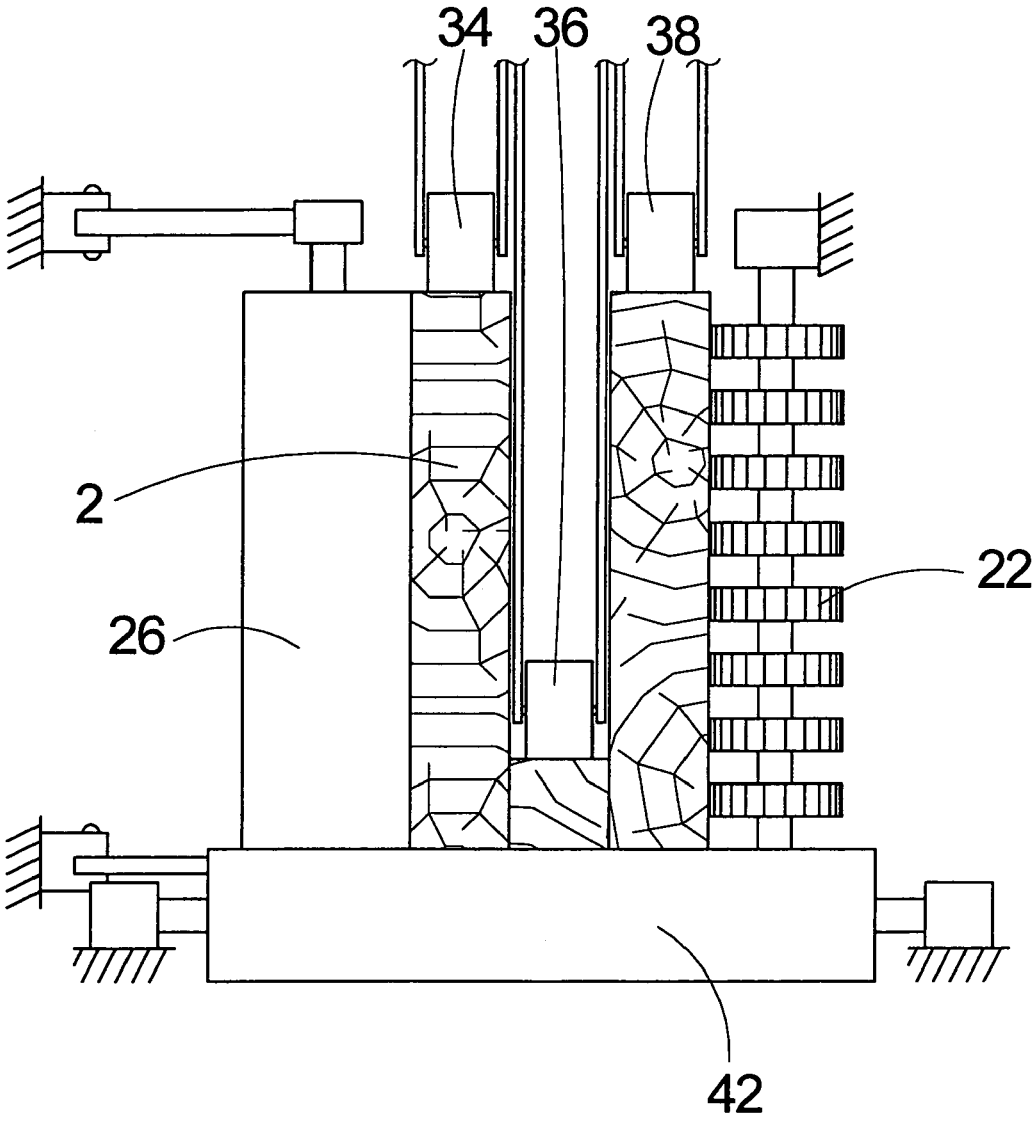
FIG. 6 is a schematic sectional view of a variation of the present invention in which the pinching roller of the alignment assembly is comprised of a plurality of sections.

Significantly, each of the nail driver assemblies 60 may be movable in a vertical direction relative to the path 14 so that structural elements of various sizes (for example, the width of a board positioned on edge) may be accommodated by the system 10, and also for adjusting the spacing between horizontal rows of fasteners driven into the structural elements moving along the path for meeting various spacing requirements for building codes and practices (see FIGS. 2 and 4). A significant optional feature of the system is the ability of the nail driver assemblies 60 to pivot in a substantially horizontal plane, so that any movement by the structural elements that may be transferred to the nail driver assembly, especially in the time period between the initial penetration of the nail into the element and the final clearing of the nail from the nail driver assembly, can be absorbed by the assembly 60 without damaging the nail driver assembly or the structure employed to support and secure the nail driver assembly. Further, should a nail remain partially lodged in one of the nail driving assemblies 60, the pivoting of the assembly 60 facilitates dislodging of the nail from the assembly 60 as the structural element moves along the path 14 by the assembly 60.

Each of the nail driver assemblies 60 may include a nail driver 68 for ejecting nails and mounting means for mounting the nail driver on the frame 12. The nail driver 68 may comprise a conventional hand held nail driver or gun tool that is actuated by air supplied to the driver, and is fed by a spool of the nails linked together in a manner known to those skilled in the art for supplying nails or other fasteners to nail guns. The mounting means preferably permits adjustment of the height of the nail driver with respect to the path 14 and structural elements moving along the path, and optionally permits horizontal pivoting or rotation of the nail driver 68.

In one embodiment of the invention, the structure of the mounting means includes an upright support 70 that is mounted on the frame 12 in a substantially vertical orientation, and a driver mount 72 that is mounted on the nail driver 70. The driver mount 72 may define a sleeve 73 that slidably receives a portion of the upright support 70 in a manner permitting upward and downward movement of the driver mount on the upright support. The nail driver mounting structure may include lifting means for raising and lowering the driver mount 72 on the upright support 70 that may include a lifting actuator 74 that extends between the driver mount 72 and the frame 12. Illustratively, extension of the lifting actuator 74 may raise the driver mount 72 on the upright support 70 relative to the path 14, and contraction or retraction of the lifting actuator lowers the driver mount on the upright support with respect to the path.

The driver mount 72 may optionally be pivotable or rotatable on the upright support 70, and this movement may be facilitated by the upright support having a substantially cylindrical exterior surface and the sleeve 73 having a substantially cylindrical interior surface. In embodiments in which the driver mount 72 is pivotable, means for resisting (but not preventing) rotation of the driver mount about the upright support may be employed to bias the nail driver 68 into a neutral position with the nail axis 66 being oriented perpendicular, or substantially perpendicular, to the movement of the structural elements along the path. It has been found that a slight tilting or angling of the nail axis 66 in the direction of the movement of the structural elements along the path may be beneficial. In one embodiment of the invention, the biasing means comprises a tension spring 76 that extends between the driver mount 72 and the frame 12 such that rotation of the driver mount out of a neutral position stretches the spring. The spring 76 may act against a stop (not shown) that prevents the nail driver from rotating past the neutral position. It will be appreciated by those skilled in the art that the biasing function may be performed in many different ways, although the means disclosed herein has been found to be especially simple and reliable.

One configuration of the nail driver assemblies 60 (illustrated in the drawings) that has been found to be highly effective for adapting to the requirements for nailing a wide variety of structural elements into finished products includes three nail driver assemblies on each side 18, 19 of the path 14. On the first side 18 of the path 14 are positioned first 78, second 79, and third 80 nail driver assemblies and on the second side 19 of the path 14 are positioned fourth 82, fifth 83, and sixth 84 nail driver assemblies, with the first and fourth, second and fifth, and third and sixth nail driver assemblies being in substantially opposed relationships across the path 14. In some embodiments of the invention, one of the nail driver assemblies on each side of the path 14 may be positioned at a substantially fixed distance above the level of the path as the distance between the relatively lowest row of nails on the building elements and the level of the path (which is generally fixed) may be uniform despite variations in the overall width of the structural elements to be fastened. In such embodiments, some or all of the driver mounting means described above may be omitted from the system.

The system 10 may also include an exit support roller 88 for supporting the structural elements as they move along the path 14. The exit support roller 88 is positioned below the path 14 such that the structural elements pass over the exit support roller as the elements move along the path 14.

The exit support roller 88 may be rotatable about a substantially horizontal axis to facilitate movement of the structural elements over the roller 88.

The system 10 may also include an exit clamping assembly 90 for clamping onto and pulling along the path 14 the structural elements on the portion of the path past the nail driver assemblies (see FIGS. 1 and 2). The exit clamping assembly 90 may include a primary exit clamping roller 92, a secondary exit clamping roller 94, and a biasing exit clamping roller 96. The rollers 92, 94, and 96 may be configured similarly to the rollers in the entry clamping assembly 20, and although other configurations are possible, it has been found that the disclosed roller configuration is highly effective for moving the structural elements through the system 10.

In greater detail, the primary exit clamping roller 92 may be located on the first side 18 of the path, may be rotatable about a substantially vertical axis, and may have a plurality of protrusions extending therefrom. The secondary exit clamping roller 94 may be located on the first side 18 of the path, and may be rotatable about a substantially vertical axis. The biasing exit clamping roller 96 may be located on the second side 19 of the path and may be rotatable about a substantially vertical axis.

The biasing exit clamping roller 96 may be biased toward the first side 18 of the path and the primary clamping roller 92, and means for biasing the roller 96 may include a second swing arm 98 that is pivotally mounted on the frame 12 and supports the roller 98. The second swing arm 98 may be pivotable between a non-biasing position on the second side 19 of the path 14 and a biasing position extending at least partially across the path to contact structural elements moving along the path. An exit biasing actuator 100 may be provided for biasing the biasing exit clamping roller 96 toward the primary exit clamping roller 92, and may comprise a hydraulic actuator having a first end operatively coupled to the frame 12 and a second end operatively coupled to the second swing arm 98.

In the illustrative embodiment of the invention, the secondary exit clamping roller 94 and the biasing exit clamping roller 96, as well as the primary exit clamping roller 92, each have protrusions extending therefrom for gripping the structural elements, and may each be formed by a plurality of sprockets or gears as described above for the primary entry clamping roller 22. The inclusion of the protrusions on more than one of the rollers of the exit clamping assembly is useful for pulling the structural elements past the nail driver assemblies, especially if a nail should not be completely disengaged from the nail driver and the nail driver becomes hung up on a partially driven nail driven into the elements. The spaced sprockets of the rollers can also minimize any damage to the system by nails that are only partially driven into the structural elements, if that should occur.

The system 10 may also include means for rotating the primary exit clamping roller 92 to move the structural elements along the path, and may comprise a dedicated motor assembly (not shown), but is preferably rotated by the motor assembly 32 through a system of connecting chains, belts, or gears that are employed to connect the primary exit clamping roller to the motor assembly 32. This structure has the advantage of providing a relatively simple way of maintaining a relatively similar rotation speed between the rollers of the primary entry 22 and exit 92 clamping assemblies.

The system 10 may also include control means for controlling the various actuators and motors that are employed in the system for moving and rotating the aforementioned elements of the system. In one embodiment of the invention (see FIG. 5), the system 10 includes a programmable logic control 102 (PLC) for accessing data and program instructions in memory 104 and for executing those instructions. The programmable logic control 102 may be in communication with the sensors of the system (such as optical sensor 50), a plurality of control valves 106 that are in fluid communication with the nail drivers 68 and the various actuators, and also power relays 108 that supply electrical power to the motor or motors of the system 10. The system 10 may include a keypad 110 or other suitable input device for entering data about the sizes and configurations of the particular structural elements placed on the path 14 by the operator, so that the PLC may pull up information from memory regarding the suitable positions of nails in the structural elements, such as the appropriate spacing of the nails in between the long side edges of the structural elements and the appropriate spacing of the nails in between the short end edges of the structural elements. The programmable logic control 102 may then adjust the vertical levels of the nail driver assemblies for appropriate spacing of the fasteners across the width of the structural elements, and may actuate the nail drivers 68 at appropriate times as the structural elements are moved through the system 10 to create the appropriate spacing of the fasteners along the length of the elements. Optionally, the system 10 may be controlled by mechanical logic apparatus including mechanical and electric switches, counters, relays, and the like.

Although the foregoing description refers to the fasteners as nails and the fastener driver devices as nail drivers, it will be recognized by those skilled in the art that other structural fasteners, and other fastener driver devices, may be suitable for use with the invention, including staples, brads, and even screws, and the suitable devices for driving or rotating those fasteners.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An apparatus for driving fasteners into structural elements moving continuously through the apparatus, the apparatus comprising:

a frame with a path extending through the frame for movement of structural elements, the path defining opposite sides of the path;

moving means for moving a plurality of structural elements along the path in a substantially continuous manner;

an entry clamping assembly for clamping together the plurality of structural elements as the structural elements move substantially continuously along the path;

an alignment assembly for aligning at least one edge of the plurality of structural elements as the structural elements move substantially continuously along the path; and fastener driving means for driving fasteners into the plurality of structural elements as the structural elements move substantially continuously along the path.

2. The apparatus of claim 1 wherein the entry clamping assembly comprises:

a primary entry clamping roller located on a first one of the sides of the path; and a biasing entry clamping roller located on a second one of the sides of the path and being biased across the path toward the first side of the path and toward the primary clamping roller for clamping the plurality of structural elements therebetween as the structural elements move along the path.

3. The apparatus of claim 2 wherein the primary entry clamping roller has a plurality of protrusions extending therefrom for gripping structural elements moving along the path.

4. The apparatus of claim 2 wherein the entry clamping assembly includes a secondary entry clamping roller located on the first side of the path adjacent to the primary entry clamping roller such that structural elements clamped against the primary and secondary entry clamping rollers are oriented substantially parallel to the path as the structural elements move along the path.

5. The apparatus of claim 2 wherein the moving means comprises means for rotating the primary entry clamping roller to move the structural elements along the path.

6. The apparatus of claim 1 wherein the alignment assembly presses against the plurality of structural elements in a direction oriented substantially perpendicular to a direction of clamping by the entry clamping assembly.

7. The apparatus of claim 1 wherein the alignment assembly comprises:

an entry support roller for supporting the plurality of structural elements moving along the path, the entry support roller being positioned below the path such that the plurality of structural elements pass over the entry support roller as the structural elements move along the path; and a pinching roller for pinching the plurality of structural elements against the entry support roller as the structural elements move substantially along the path, the pinching roller being movable toward the path and the entry support roller.

8. The apparatus of claim 1 wherein the fastener driving means comprising a plurality of fastener driving assemblies including at least one fastener driving assembly positioned on a first one of the sides of the path and at least one fastener driving assembly positioned on a second one of the sides of the path.

9. The apparatus of claim 1 additionally comprising an exit clamping assembly located along the path after the fastener driving means for clamping together the plurality of structural elements after the structural elements have moved along the path past the fastener driving means.

10. The apparatus of claim 1 additionally comprising a stop means for stopping initial insertion movement of the plurality of structural elements along the path for aligning forward ends of the plurality of structural elements prior to clamping the structural elements together.

11. An apparatus for driving fasteners into structural elements moving through the apparatus, the apparatus comprising:

a frame with a path extending through the frame for movement of structural elements, the path defining opposite bides of the path;

moving means for moving a plurality of structural elements along the path;

an entry clamping assembly for clamping together the plurality of structural elements as the structural elements move along the path;

an alignment assembly for aligning at least one edge of the plurality of structural elements as the structural elements move along the path; and fastener driving means for driving fasteners into the plurality of structural elements as the structural elements move along the path;

wherein the fastener driving means drives: fasteners along an axis, a position of the fastener driving means being adjustable such that the axis of the fasteners driven by the fastener driving means is adjustable in height above the path.

12. An apparatus for driving fasteners into structural elements moving through the apparatus, the apparatus comprising:

a frame with a path extending through the frame for movement of structural elements, the path defining opposite sides of the path;

moving means for moving a plurality of structural elements along the path;

an entry clamping assembly for clamping together the plurality of structural elements as the structural elements move along the path;

an alignment assembly for aligning at least one edge of the plurality of structural elements as the structural elements move along the path; and fastener driving means for driving fasteners into the plurality of structural elements as the structural elements move along the path;

wherein the path is substantially horizontally oriented, and the fastener driving means is pivotable with respect to the path in a substantially horizontal plane.

13. An apparatus for driving fasteners into structural elements moving through the apparatus, the apparatus comprising:

a frame with a path extending through the frame for movement of structural elements, the path defining opposite sides of the path;

moving means for moving a plurality of structural elements along the path;

an entry clamping assembly for clamping together the plurality of structural elements as the structural elements move alone the path;

an alignment assembly for aligning at least one edge of the plurality of structural elements as the structural elements move along the path; and fastener driving means for driving fasteners into the plurality of structural elements as the structural elements move along the path;

wherein the fastener driving means comprises a plurality of nail driver assemblies for each ejecting nails along a nail axis extending into the path, each of the nail driver assemblies being movable in a vertical direction relative to the path, each of the nail driver assemblies being pivotable in a substantially horizontal plane.

14. The apparatus of claim 13 wherein each of the nail driver assemblies comprises:

a nail driver for ejecting nails; and mounting means for mounting the nail driver on the frame.

15. The apparatus of claim 14 wherein the mounting means comprises:

an upright support mounted on the frame in a substantially vertical orientation; and a driver mount mounted on the nail driver and defining a sleeve receiving a portion of the upright support in a manner permitting upward and downward sliding on the upright support, the driver mount being rotatable on the upright support.

16. The apparatus of claim 15 wherein the mounting means additionally comprises lifting means for raising and lowering the driver mount on the upright support.

17. The apparatus of claim 15 wherein the mounting means additionally comprises biasing means for biasing the driver mount against rotation about the upright support.

18. An apparatus for driving fasteners into structural elements moving through the apparatus, the apparatus comprising:

a frame with a path extending through the frame for movement of structural elements, the path defining opposite sides of the path;

moving means for moving a plurality of structural elements along the path;

an entry clamping assembly for clamping together the plurality of structural elements as the structural elements move along the path;

an alignment assembly for aligning at least one edge of the plurality of structural elements as the structural elements move along the path; and fastener driving means for driving fasteners into the plurality of structural elements as the structural elements move alone the path;

a triggering means for triggering pinching movement of the alignment assembly and clamping movement of the entry clamping assembly when the plurality of structural elements are sensed on the path.

19. An apparatus for driving fasteners into structural elements moving continuously through the apparatus, the apparatus comprising:

a frame with a path extending through the frame for movement of structural elements, the path defining opposite sides of the path;

a moving assembly configured to move a plurality of structural elements along the path;

an entry clamping assembly configured to clamp together the plurality of structural elements as the structural elements move along the path; and a fastener driving assembly configured to drive fasteners into the plurality of structural elements as the structural elements move along the path;

wherein the fastener driving assembly is configured to drive fasteners at an adjustable height above the path.

20. The apparatus of claim 19 wherein the fastener driving assembly is configured to drive fasteners at a plurality of heights above the path.

21. The apparatus of claim 19 wherein the fastener driving assembly is capable of simultaneously driving fasteners at a plurality of heights above the path.

* * * * *